United States Patent [19]

Stoppazzini

[11] Patent Number: 4,854,134

[45] Date of Patent: Aug. 8, 1989

[54] DEVICE FOR EFFECTING AND MAINTAINING THE VERTICAL TENSION OF THE FABRIC IN AUTOMATIC FLAT KNITTING MACHINES

[75] Inventor: Benito Stoppazzini, Sala Bolognese, Italy

[73] Assignee: E.M.M. S.R.L., Italy

[21] Appl. No.: 250,768

[22] Filed: Sep. 28, 1988

[30] Foreign Application Priority Data

Oct. 2, 1987 [IT] Italy ..... 3628 A/87

[51] Int. Cl.[4] ..... D04B 15/88

[52] U.S. Cl. ..... 66/152

[58] Field of Search ..... 66/149 R, 150, 152

[56] References Cited

U.S. PATENT DOCUMENTS

| | | | |
|---|---|---|---|
| 4,503,689 | 3/1985 | Goller et al. | 66/152 X |
| 4,549,214 | 10/1985 | Stoll et al. | 66/149 R |
| 4,592,412 | 6/1986 | Goller et al. | 66/150 X |

FOREIGN PATENT DOCUMENTS

| | | |
|---|---|---|
| 0135640 | 3/1985 | European Pat. Off. . |
| 0216735 | 1/1987 | European Pat. Off. . |
| 2648612 | 3/1978 | Fed. Rep. of Germany . |
| 2551097 | 1/1985 | France . |

*Primary Examiner*—Ronald Feldbaum

*Attorney, Agent, or Firm*—Darby & Darby

[57] ABSTRACT

The device comprises drums, which are coaxial and supported by an axle, located below needle beds subjected to a constant torque acting with springs being provided inside the drums as a mechanical connection between them and the axle.

Two pressure rollers for each drum are fitted to a number of arms mounted on a bar and holded in contact with the related drum, while electromagnets are provided to rotate one of the rollers by a predetermined amount in order to cause the related drum to be rotated in in synchrony with the formation of a corresponding portion of the last row of the fabric, that runs between the row of drums and related pairs of pressure rollers.

5 Claims, 1 Drawing Sheet

DEVICE FOR EFFECTING AND MAINTAINING THE VERTICAL TENSION OF THE FABRIC IN AUTOMATIC FLAT KNITTING MACHINES

BACKGROUND OF THE INVENTION

The present invention concerns the manufacturing sector of automatic flat knitting machines, specifically concerning a device for effecting and maintaining the vertical tension of the fabric in automatic flat knitting machines.

DESCRIPTION OF THE PRIOR ART

Known automatic flat knitting machines are in most cases equipped with electronic control units using knitting programs.

These machines generally comprise two needle beds over which a carriage moves with a longitudinal outwards and return motion; this carriage mounting, operating upon it, what are known as the needles' selection systems, or, more simply, as operating units, these latter located in transverse slits in the needle beds.

The operating units are designed to lift and subsequently lower the needles in succession, following the control signals they are sent by the electronic control unit, in order to form in series what are known as the rows of fabric, in a zone that extends dynamically between the upper longitudinal heads of the needle beds and is known to technicians in the sector as the needles' work zone.

In certain cases vertical tension is exerted upon the fabric by two rollers of the same length as the length of the needle beds of the machine, these rollers featuring knurled circumferential surfaces, being mounted so that they are in contact with one another and located below, and parallel to the needle beds.

The two rollers are made to rotate in opposite directions for preset periods of time at the end of each stroke of the carriage, following, for example, control signals sent to corresponding electric motors by the electronic control unit in accordance with instructions inserted as required in the knitting program.

The traction exerted on the fabric by the rollers is not differentiated along their longitudinal development, as a result of which the portions of fabric dynamically situated by the operating units are not subjected to the same amount of tension.

The fabric, indeed, slackens, lengthening when every operating unit passes.

This happens to a greater extent in machines of more modern manufacture, where the carriage is fitted with a high number of operating units, (up to four, for example), in order to successively form a number of rows equal to the number of operating units for every stroke of the carriage itself.

It is clear that the progressive slackening of the fabric is in these cases higher in the work zones that follow the first operating unit.

This non-uniform tension in the various different work zones results in unsatisfactorily knitted fabric.

Another type of known device for maintaining the tension of the fabric comprises one single roller that is able to turn, which extends along the entire length of the needle bed below which it is located, and which has a circumferential surface that features a large number of small pegs which are designed to slot between the stitches of the fabric.

This roller can be located in a zone very close to the needles' work zone, thus minimising the effects caused by the non-uniform tension of the fabric, without, however, eliminating them.

In addition to this, since the motor means operating on the rollers in both the above solutions are usually of the constant torque type, which is to say that they continually adjust whilst acting upon the rollers in order to subject the latter to a constant, or almost constant, torque value, the loosening over time of the fabric downstream of the carriage causes an increase in the stress to which the fabric upstream of the carriage is subjected, with a further negative effect on the final results. FR No. 2.079.540 describes a device for maintaining the vertical tension of the fabric being formed in an automatic flat knitting machine.

The device comprises a series of traction rollers which idle on the same axle located beneath the needle beds, opposed by a series of corresponding pressure rollers, which idle on a second axle parallel to the first one, and which are held in contact with the traction rollers by related loaded springs.

The fabric produced by the machine passes between the traction rollers and pressure rollers.

Working in conjunction with the traction rollers are an equal number of drive discs, each of which acts on its corresponding roller by means of a freewheel mechanism in order to cause the roller to rotate intermittently in a single predetermined direction.

The drive discs are subjected to the action of rods which cause them to rotate in one direction by a predetermined amount with each stroke of the carriage, causing each roller to rotate by the same amount in the same direction, and then in the opposite direction, leaving the same roller stationary since it is held in position by its related pressure roller, which is in turn held stationary by a freewheel mechanism that operates in the opposite direction to the first one.

In addition to this, the return rotation of the disc loads an associated spring which has the purpose of resetting the fabric tension value at a point in time following the formation of the related section of the last row.

This last device is, however, extremely complex, and this has negative effects on its operating efficiency, manufacturing costs and times, and subsequent maintenance operations.

Operating efficiency is not always achieved, partly because the elastic reaction of the spring is not always sufficient to completely reset the predetermined tension value. The desired results are thus only partly achieved.

SUMMARY OF THE INVENTION

The object of the present invention is to produce a device able to impose, in a vertical direction, a given tension on the knitting of the fabric, and to maintain this tension, acting on contiguous stretches of the fabric, in response to the control signals sent by an electronic control unit and inserted as necessary in a knitting program, all this being achieved in an extremely functional and simple manner, without having any negative effects on the operating speed of the machine upon which the device is to be mounted.

The objects mentioned above, are achieved by a device for effecting and maintaining the vertical tension of fabric in an automatic flat knitting machine, said knitting machine comprising two flat longitudinal needle beds with said knitted fabric descending below said needel beds and said device comprising: a row of coaxial drums supported so that they are able to turn by an axle, said axle being located below and parallel to said needle beds, as well as said axle being made to rotate with constant torque in a predetermined direction; first elastic means located inside each of said drums as a mechanical connection between said drum and said axle, in order to exert a torque upon said drums that corresponds to and is in accordance with the torque subjecting said axle; at least two pressure rollers, respectively first roller and second roller for each of said drums, said rollers being supported so that they are able to turn by mounting means, with said mounting means keeping said rollers in contact with a related drum with a predetermined pressure, due to an action exerted by second elastic means; actuator means provided for each pair of said pressure rollers designed to rotate at least said first pressure roller by a predetermined amount, in order to cause said related drum to rotate by a corresponding amount in accordance with the direction of the action of said pair of pressure rollers acting on the aforementioned axle, in synchrony with the formation of a corresponding portion of last row of said fabric, with said fabric placed between said row of drums and said related pairs of pressure rollers.

BRIEF DESCRIPTION OF THE DRAWINGS

The characteristics of the invention not have emerged above are emphasised hereinafter with specific reference to the enclosed drawings, in which.

DESCRIPTION OF THE PREFERRED EMBODIMENT

With reference to the said drawings, shown at 1 is the device which is the subject of the present invention.

Figure 2:
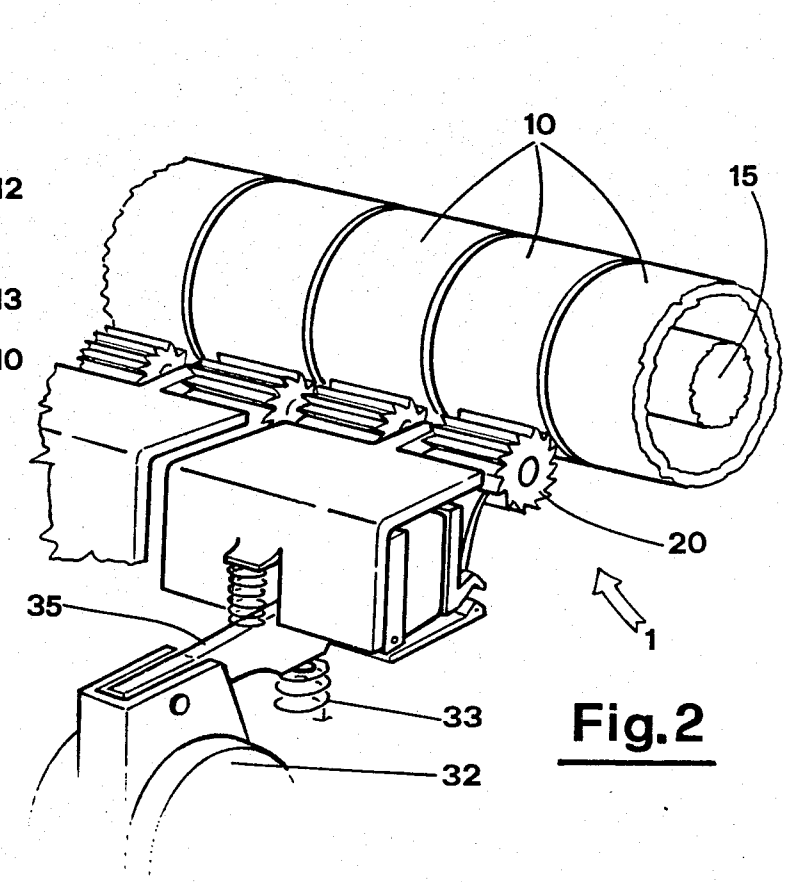
FIG. 2 is a diagrammatic view in perspective of a detail of the device in question.
Figure 1:
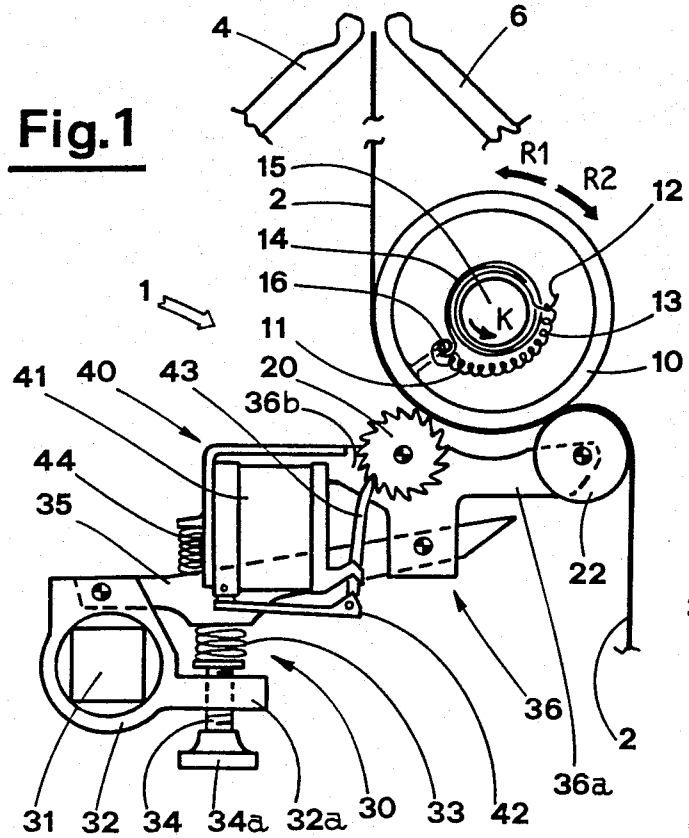
FIG. 1 is a diagrammatic side view of the device.

In FIG. 1, the device 1 has been illustrated in its work position, which is to say below the two needle beds 4 and 6 of an automatic flat knitting machine from which descends the knitted fabric 2 being formed.

A series of drums 10 form part of the device, these drums 10 being coaxially supported so that they are able to turn and located in a row upon an axle 15, which is in its turn supported parallel to the needle beds 4 and 6 by the structure of the machine (not illustrated).

The axle 15 is subjected to the action of a constant-torque motor, (not illustrated in that of known type), which imparts torque to it in a predetermined direction K.

The outside circumferential surface of the drums is covered with, for example, a strip of knurled rubber.

An elastic ring 14 passes, for example, several turns around the axle 15, at a point corresponding to each drum 10, and close up against the axle 15, and is held in place using known systems so that it does not turn around the axle.

The end parts of the ring 14 are shaped in such a way as to form the same number of hooks 11 and 12.

A striker pin 16 is fitted, using known techniques, to the inside of the bottom wall of each drum 10.

The hooks 11 and 12 strike against the striker pin 16 in such a way as to limit the relative rotation in opposite directions R1 and R2 between each drums 10 and axle 15 to a predetermined value.

Elastic means 13 in each drum, in the present case comprising one or more springs of, for example, the helical type, mechanically and elastically connect the pin 16 and hook 12, which are bilaterally located in relation to the remaining hook 11.

In addition to this, the invention features a pair of pressure rollers 20 and 22 for each drum, these pressure rollers 20 and 22 being mounted so that they are able to turn to mounting means 30, and located below the related drum 10, being held in contact with the latter at a predetermined pressure by the same mounting means 30, described below.

A bar 31 is supported by the structure of the machine so that it is located slightly below, parallel to and to one side of the axle 15.

Collars 32, of which there are half the number as there are drums 10, work in conjunction with the bar 31 in such a way that the latter run inside and alongside them, each collar 31 featuring a plate **32*a* that is horizontally mounted to the said facing the drums 10**.

One end of an arm 35 is hinged to the top part of each coller 32, the free end of this arm being located beneath the drums 10.

A screw 34 engages perpendicularly with the plate **32*a* in such a way that it projects below it with a knob 34*a*, whilst its opposite end, projecting above the plate 32*a*, presses on the arm 35 by means of the action of a spring 33**, located between them.

A laminar element 36 is hinged near the free end of the arm 35, this laminar element 36 comprising an L-shaped first part **36*a*, located beneath the drums 10** at a point corresponding to a vertical plane defined by two contiguous drums.

Part **36*a* mounts, on each of its faces, two pressure rollers 20 and 22**.

The first roller 20, with a toothed outside profile, is located between the hinge axis of the related element 36 and the hinge axis of the related arm 35.

The second roller 22, with a smooth profile, is located, in relation to axle 15, on the opposite side of the hinge axis of the element itself.

Each pair of rollers 20 and 22 is thus pressed against the surface of the corresponding drum 10 by the arm 35 and element 36, as a result of the elastic reaction of the spring 33.

Part **36*b* of the element 36, located to one side of the drums 10, between them and the bar 31, serves as a mounting for actuator means 40, which in the present case comprise a pair of electromagnets 41**.

The armature 42 of each electromagnet 41 works in conjunction with a pawl 43, which is designed to engage with the toothed surface of the related roller 20, forming a ratchet gear.

Activation of the electromagnet 41, and the consequent movement of the armature 42, cause the roller 20 to rotate by a predetermined fraction of a revolution.

Finally, a spring 44 has the purpose of raising the element 36 to a predetermined position when the two rollers 20 and 22 are not in contact with the related drum 10, such as, for example, is necessary when inserting the fabric 2 between them.

The bar 31 can be lowered, causing all the pairs of rollers 20 and 22 to move away from their related drums 10, making it possible to insert the fabric between them.

When the machine is operating, the fabric is thus inserted between the row of drums 10 and the rows of pressure rollers 20 and 22.

The axle 15 turns, as a result of the activation of the constant-torque motor which acts upon it, thus placing each spring 13 under tension, these in their turn drawing round the related drum 10 in direction R1.

The rotation of axle 15 ceases when the elastic reaction of the fabric 2 imparts an overall torque to the drums 10 that is equal and opposing to the torque to which the axle 15 is subjected.

Considering a section of fabric as wide, for example, as the distance between two operating units, the passing of each operating unit present on the carriage gives rise to the formation of a row of fabric, and a consequent decrease in the intensity of the elastic reaction of the fabric below.

At this point the elastic reaction of the spring 13, acting on the drum corresponding to this section of fabric, causes the drum to rotate in direction R1, independently of the remaining drums, until the fabric returns to the preset tension, restoring the balance between the elastic reaction of the fabric and elastic reaction of the spring 13.

To optimise performance of the above, and ensure that the required tension value is restored, the electromagnet 41 is activated at the moment in which the drum and rollers turn, this being effected by means of a series of signals that are sent to it by the electronic control unit (not illustrated), following the instructions inserted as necessary in the knitting program.

When the overall torque value imparted, in direction R2, to the row of drums 10 by the elastic reaction of the fabric, and thus to the axle 15 by means the springs 13, falls below the predetermined value, the torque acting in direction K on the axle 15 causes the latter to rotate until it restores the fabric tension to the predetermined value once again.

Any excessive rotation of the axle 15 in relation to the drums 10, which would cause the springs 13 to become twisted round the latter, is avoided by the fact that the hook 12, to which the spring 13 is fixed, strikes against the striker pin 16 before this can happen.

The hook 11, on the other hand, strikes against striker pin 16, thus preventing the springs 13 from slackening when there is no fabric or when the pressure rollers are not in contact with their related drums.

The device thus places the fabric under a practically uniform longitudinal tension as described above for all the contiguous sections of the fabric, independently of the difference in length between the various different zones of the latter, corresponding to the related operating units mounted on the carriage, as well as the zones upstream and downstream of the carriage itself, this difference being due to the formation of several rows in succession.

With regard to this, it should be emphasised that the width of the drums 10 is equal to the distance between two contiguous operating units, in order to optimise the timing governing operation of the electromagnets 41.

The pressure with which the rollers 20 and 22 are held against the related drums 10 can be adjusted by acting on the knob 34*a* of the screw 34.

Roller 20 is thus made to rotate by electromagnetic means, which makes it possible to obviate the use of complicated mechanical transmission means, such as camshafts or other such means, instead employing flexible connection means (electrical cables) which are more practical and functional.

The advantages of being able to control the rotation of the drums electronically in order to restore the predetermined tension value are clear from the above.

In addition to this, the device is also of simple construction, this having positive effects on both its manufacturing costs and any maintenance that might be required at a later date.

It is to be understood that the description supplied herein is solely an unlimited example and not binding, such that possible variations in the construction details will not effect the protective framework afforded to the invention as described above and claimed hereinafter.

What is claimed is:

1. A device for effecting and maintaining the vertical tension of fabric in an automatic flat knitting machine, said knitting machine comprising two flat longitudinal needle beds with said knitted fabric descending below said needel beds and said device comprising:

a row of coaxial drums supported so that they are able to turn by an axle, said axle being located below and parallel to said needle beds, as well as said axle being made to rotate with constant torque in a predetermined direction;

first elastic means located inside each of said drums as a mechanical connection between said drum and said axle, in order to exert a torque upon said drums that corresponds to and is in accordance with the torque subjecting said axle;

at least two pressure rollers, respectively first roller and second roller for each of said drums, said rollers being supported so that they are able to turn by mounting means, with said mounting means keeping said rollers in contact with a related drum with a predetermined pressure, due to an action exerted by second elastic means;

actuator means provided for each pair of said pressure rollers designed to rotate at least said first pressure roller by a predetermined amount, in order to cause said related drum to rotate by a corresponding amount in accordance with the direction of the action of said pair of pressure rollers acting on the aforementioned axle, in synchrony with the formation of a corresponding portion of last row of said fabric, with said fabric placed between said row of drums and said related pairs of pressure rollers.

2. A device as in claim 1, wherein said mounting means comprise:

a bar located to one side and at a lower height of, and parallel to said axle;

a number of collars, with said bar running inside said collars, each of said collars having a plate that is an integral part of said collar;

an arm for each of said collars, one end of said arm being hinged to a collar, and a free end of said arm being located below a corresponding pair of said drums; a screw that engages with the said plate, said screw acting with one end on said arm, with said second elastic means being located between said end of said screw and said arm;

an element hinged to the free end of said arm, supporting said first pressure roller and second pressure roller, with one part of said element being located below a related drum, and with a remaining part of said element mounting said actuator means.

3. A device as in claim 2, wherein said actuator means comprise at least one electromagnet with a pawl fitted to an armature of said electromagnet, said pawl being designed to engage in at least said first roller, with a toothed surface carried out on the outside circumference of said first roller.

4. A device as in claim 2, comprising third elastic means fitted to said arm, said third elestic means acting upon said second part of said element, in order to keep said element in a predetermined position when said pressure rollers are not in contact with said related drum, as well as when no fabric is present between said pressure rollers and said axle.

5. A device as in claim 1, wherein said first elastic means comprise a spring fixed to the bottom of said related drum by means of a pin and fixed to said axle by means of a hook.

* * * * *